US005241353A

United States Patent [19]

Maeshima et al.

[11] Patent Number: 5,241,353

[45] Date of Patent: Aug. 31, 1993

[54] PAPER-DISCHARGING TRAY

[75] Inventors: Masanobu Maeshima, Habikino; Eiji Tsutsui, Sanda; Makoto Eki, Osaka; Hiroki Morishita, Nara; Junya Sasabe, Kobe, all of Japan

[73] Assignee: Mita Industrial Co., Ltd., Osaka, Japan

[21] Appl. No.: 783,875

[22] Filed: Oct. 29, 1991

[30] Foreign Application Priority Data

Nov. 17, 1990 [JP] Japan ..... 2-312187

[51] Int. Cl.[5] ..... G03G 21/00

[52] U.S. Cl. ..... 355/321; 271/207; 271/209; 271/213; 271/220; 355/308; 355/309

[58] Field of Search ..... 271/207, 209, 213, 220; 355/308, 309, 321

[56] References Cited

U.S. PATENT DOCUMENTS

| | | | |
|---|---|---|---|
| 4,652,110 | 3/1987 | Sato et al. | 162/271 X |
| 5,111,252 | 5/1992 | Hamada et al. | 355/308 |
| 5,118,093 | 6/1992 | Makiura et al. | 271/213 X |
| 5,119,138 | 6/1992 | Oda et al. | 355/309 X |
| 5,132,741 | 7/1992 | Kitajima et al. | 355/309 X |

*Primary Examiner*—A. T. Grimley
*Assistant Examiner*—J. E. Barlow, Jr.
*Attorney, Agent, or Firm*—Wenderoth, Lind & Ponack

[57] ABSTRACT

A paper-discharge tray for an image-forming apparatus is adapted to hold paper discharged by a paper-discharging device arranged downstream of a fixing device in the image-forming apparatus. The free end of the paper-discharge tray is adapted to be bent in the direction in which the paper will curl when it passes through the fixing device, such that the paper can be stably stacked even when it curls during the fixing process.

20 Claims, 5 Drawing Sheets

PAPER-DISCHARGING TRAY

BACKGROUND OF THE INVENTION

1. Field of the Invention

The present invention relates to a paper-discharging tray used in an image-forming apparatus such as a laser printer or an electrostatic photographic copying machine.

2. Description of the Prior Art

FIG. 5 shows a portion of a conventional laser printer in the vicinity of a paper-discharging portion. Referring to FIG. 5, reference numeral 61 designates a fixing device provided with a heating roll 62 and a pressing roll 63 arranged therewithin so as to contact one another. Reference numeral 64 designates a paper-discharging device which is arranged on the downstream side of the fixing device 61 and comprises upper and lower rolls 65, 66 arranged so as to contact one another. And, reference numeral 67 designates a paper-discharging tray which is arranged on the downstream side of the paper-discharging device 64 and has an upper surface 68 formed so straight (or linear) as seen in side view and an idle (or free) end portion 69. The paper-discharging tray 64 is mounted on a side plate 71 of a body of the laser printer in such a manner that the tray is inclined such that the idle end portion 69 is slightly above a base end portion 70.

With this construction, a paper 72 conveyed from a transfer device (not shown) is subjected to an appointed fixing treatment as it passes between the rolls 62, 63 of the fixing device 61 and then passes between the rolls 65, 66 of the paper-discharging device 64 to be discharged onto the paper-discharging tray 67 with an image-forming surface facing upwardly.

However, in the laser printer, slightly thick papers, such as post cards and envelopes, may be used as the paper 72 on which an image is to be formed, in addition to the usual copying paper (referred to as usual paper) when papers are doubled (or tripled), such as with envelopes, the upper paper and lower paper will undergo different degrees of heat-shrinkage when they pass between the rolls 62, 63 of the fixing device 61. Thus, the paper 72 is liable to be curled along the upper heating roll 62 such that the paper 72 received on the paper-discharging tray 67, which has passed through the paper-discharging device 64, will be curled toward the image-forming surface 73 side, as shown in FIG. 5. Because the above-described conventional paper-discharging tray 67 has a form corresponding to the shape of the usual paper, the problem may arise that, for example, the discharged papers 72 become misshaped during the storage or may fall out of the paper-discharging tray 67.

In addition, in the laser printer or the like, when the paper, which has passed through the fixing device and the paper-discharging device, is disposed with its image-forming surface turned downward, (i.e. the so-called face down condition), the paper-discharging tray is arranged above the body of the laser printer (although this is not shown) and the paper-discharging tray is disposed at a considerable incline (of for example about 40°).

Because, when the paper-discharging tray is substantial-ly horizontal, it is necessary in order to maintain an appointed storage capacity to arrange the paper-discharging device at a position above the paper-discharging tray. This arrangement, however, disadvantageously results in an increase in the overall size of the laser printer.

However, when the paper-discharging tray is positioned at an incline, a leading end of unusually flexible paper may not be properly raised to the end of the sharply inclined paper-discharging tray, thereby causing the stocking capacity of the paper in the tray to be reduced.

SUMMARY OF THE INVENTION

The present invention has been achieved with the above described matters in mind, and it is an object of the present invention to provide a paper-discharging tray having a stabilized stocking capacity capable of holding not only the usual paper but also paper which is liable to curl during the fixing process without the paper becoming misshaped or falling out of the tray, and capable of satisfactorily holding unusually flexible paper in the face down condition.

In order to achieve the above described object, the present invention adopts the following measures:

According to a first measure, a paper-discharging tray, provided for holding paper discharged by a paper-discharging device arranged downstream of a fixing device, has a free end which is adapted to be bent in the direction in which the paper curls when it passes through the fixing device.

According to a second measure, in the inclined paper-discharging tray, in which the paper is held with its image-forming surface facing downward, the paper discharged through the paper-discharging device arranged downstream of the fixing device is adapted to be bent pivoting its free end toward a horizontal position.

According to the first measure, when paper which does not become curled during the fixing process (referred to hereinafter as usual or normal paper) is used, the paper can be stably stacked by placing the paper-discharging tray, as seen in side view, in a straight posture similar to the posture of a conventional paper-discharging tray.

When paper such as envelope, is used which is liable to curl during the fixing process, the curled paper can be held on the upper surface of the paper-discharging tray without falling off the tray. Thus, the curled paper can be stably stacked by bending a part of the free end of the paper-discharging tray in the direction in which the paper curls during the fixing process.

In addition, according to the second measure, when stiff paper (e.g. normal paper) is used, the paper can be stably stacked by making the shape of the paper-discharging tray straight as seen in side view to have posture similar the conventional paper-discharging tray.

Even when unusually flexible paper is used, the leading end thereof can be properly raised along the sharply inclined paper-discharging tray. Thus, the paper is held on the upper surface of the paper-discharging tray, and the stacking capacity is improved, by bending the free end of the paper-discharging tray toward the horizontal direction.

BRIEF DESCRIPTION OF THE DRAWINGS

One preferred embodiment of the present invention is shown in FIGS. 1 and 2, in which.

DESCRIPTION OF THE PREFERRED EMBODIMENTS

Figure 1:
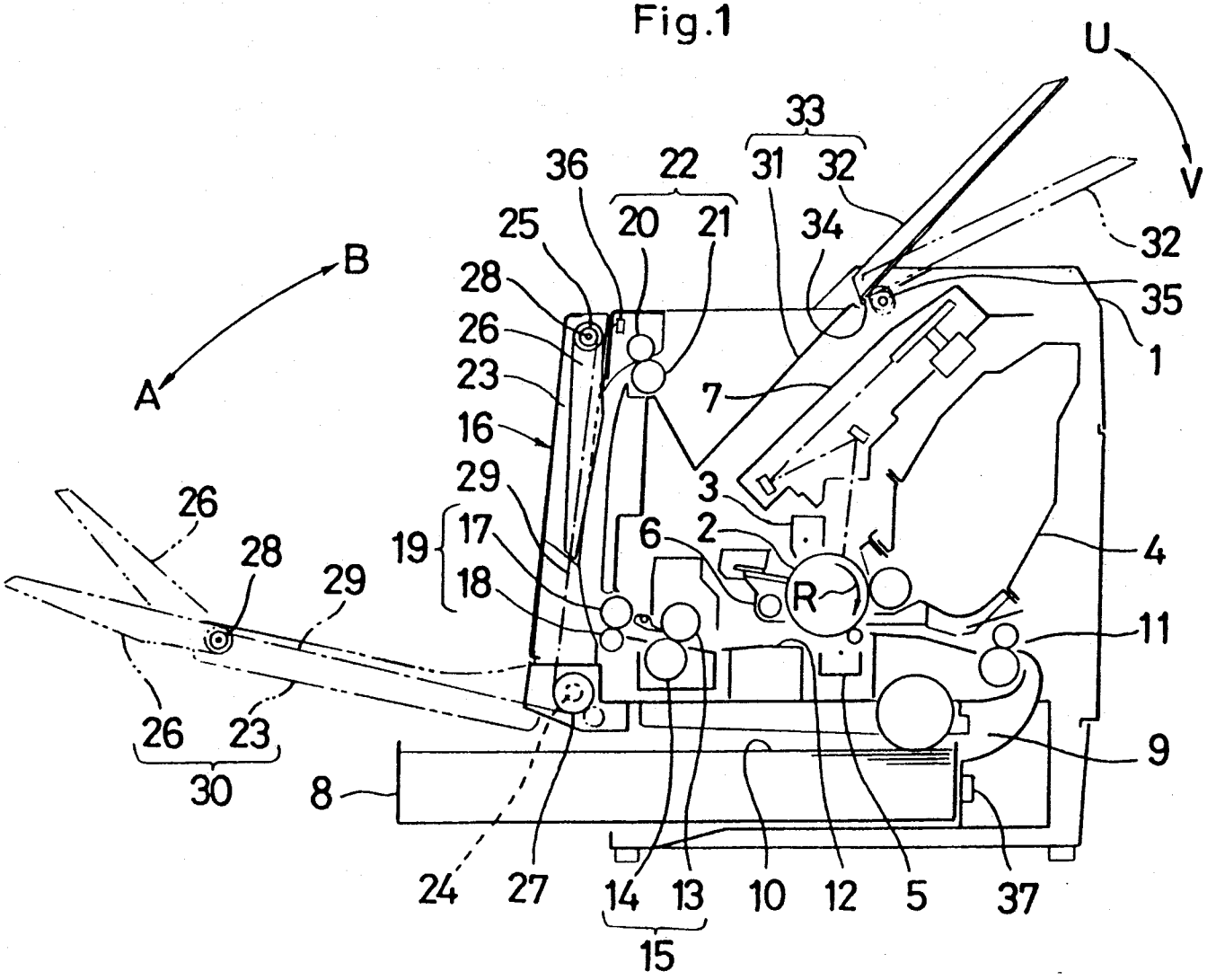
FIG. 1 is a rough longitudinal section side view showing a laser printer as one example of an image-forming apparatus.

FIG. 1 roughly shows a laser printer as one example of an image-forming apparatus. Referring now to FIG. 1, reference numeral 1 designates a body of the printer comprising a photoreceptor 2 arranged to be rotatable in a direction shown by an arrow R, as well as a charging device 3, a developing device 4, a transfer device 5, and a cleaning device 6 arranged successively around the photoreceptor 2 in the order described along the direction of rotation shown by the arrow R.

An optical unit 7 is arranged in an upper space of the body 1 of the printer, and a charging portion 9 of a cassette case 8 is formed in a lower space of the body 1 of the printer. In addition, the printer includes, on a downstream side of the transfer device 5, a paper-conveying device 11 for conveying a paper 10 sent from the cassette case 8 toward the charging device 9, a paper-conveying device 12 for conveying the paper 10 after an image has been transferred thereonto, a fixing device 15 comprising a heating roller 13 for fixing the image transferred onto the paper 10 and a pressing roller 14, and a paper-discharging device 16 for turning over the paper 10 after the fixing process to discharge the paper 10 to an upper portion of the body 1 of the printer.

The paper-discharging device 16 comprises a paper-discharging device including a first pair 19 of paper-discharging rollers 17, 18 arranged immediately downstream of the fixing device 15 for discharging the paper 10, and a second pair 22 of paper-discharging roller 20, 21 arranged above the first pair of paper-discharging rollers 19. A passage-constituting member 23 extending adjacent both pairs of paper-discharging rollers 19, 22 is engaged with a pivot shaft 24 arranged below the first pair of paper-discharging roller 19 so that the passage-constituting member 23 can be pivoted in a direction shown by an arrow A–B. The passage-constituting member 23 also serves as a main tray portion of a first paper-discharging tray 30 which will be mentioned later.

In addition, in order to hold the passage-constituting member 23 in the position shown by a full line in FIG. 1, an attracting device comprising a magnet is disposed between, for example, the body of the printer 1 and the passage-constituting member 23. The passage-constituting member 23 is held in the position shown by an imaginary line in FIG. 1 by its own weight.

An auxiliary tray portion 26 is provided on an idle (or free) end of the passage-constituting member 23 so as to be rotatable about an axis of rotation 25, and a wire 29 extends about pulleys 27, 28 rotatable about axes of rotation 24, 25, respectively. Upon manually rotating the passage-constituting member 23 in the direction shown by the arrow A to bring it into the position shown by the imaginary line, the axis of rotation 24 is suitably rotated by means of a first motor (not shown) and thus the auxiliary tray portion 26 is suitably rotated about the axis of rotation 25. Thus, the first paper-discharging tray 30 is capable of holding the paper 10, which has been subjected to the fixing treatment, in the face-up condition by means of the main tray portion 23, which also constitutes the passage-constituting member, and the auxiliary tray portion 26. In this case, the paper 10 is held mainly by means of the main tray portion 23.

In the first paper-discharging tray 30, the auxiliary tray portion 26 is rotated so that an upper surface of the auxiliary tray portion 26 is aligned with an upper surface of the main tray portion 23 (a first posture) when the cassette case 8 other than that for use with envelopes is housed in the charging portion 9. The auxiliary tray portion 26 is rotated so that the upper surface of the auxiliary tray portion 26 is positioned above the upper surface of the main tray portion 23 and the auxiliary tray portion 26 is bent upward (a second posture) when the cassette case 8 for use with envelopes is housed in the charging portion 9. That is, the auxiliary tray portion 26 is rotated so as to be bent in the same direction as the paper 10 will be curled when subjected to the fixing treatment.

On the other hand, upper surface plates of the body 1 of the printer located above the fixing device 15 and the optical unit 7 are inclined upwardly from a position below the pair of second paper-discharging roller 22 to form a main tray portion 31. Reference numeral 32 designates an auxiliary tray portion connected with an inclined upper side of the main tray portion 31, and the main tray portion 31 and the auxiliary tray portion 32 form a second paper-discharging tray 33 for receiving the paper 10, which has been subjected to the fixing treatment, in the face-down condition. The auxiliary tray portion 32 is pivoted on a fulcrum 34 at an end portion thereof connected to the body 1, and a cam 35, which is driven by means of a second motor (not shown), is engaged with a lower surface of the auxiliary tray portion 32 near the end portion thereof connected to the body 1. The auxiliary tray portion 32 is rotated in a direction shown by an arrow U - V by rotating the cam 35 to vary the portion thereof which is in engagement with the main tray portion 31.

The auxiliary tray portion 32 is rotated so that an upper surface of the auxiliary tray portion 32 is aligned with an upper surface of the main tray portion 31 (a first posture; shown in solid line in FIG. 1) when the cassette case 8 other than that for use with envelopes is housed in the charging portion 9, and the auxiliary tray portion 32 is rotated so that the upper surface of the auxiliary tray portion 32 positioned below the position in which it was aligned with the upper surface of the main tray portion 31 (a second posture; shown in imaginary line in FIG. 1) when the cassette case 8 for use with envelopes or the cassette 8 housing especially flexible paper therein is housed in the charging portion 9. That is, the auxiliary tray portion 32 is rotated so as to be bent in a direction, in which the paper 10 will curl when subjected to the fixing treatment.

Reference numeral 36 designates a switch for a first motor (not shown) as a driving source for displacing (or pivoting) the auxiliary tray portion 26 and a second motor (not shown) as a driving source for displacing the auxiliary tray portion 32. The switch 36 is switched on and off upon rotation of the main tray portion 23, so that the switch 36 may be, for example, switched on to drive the second motor in one direction when the main tray portion 23 is held at a position shown by a full line in FIG. 1 and switched off to drive the second motor in another direction when the main tray portion 23 is rotated into the position shown by an imaginary line in FIG. 1. Reference numeral 37 designates a size-detecting member disposed in the charging portion for detecting the type of cassette case (size of the paper) being employed.

Operation of the laser printer having the above described construction will be described below with reference to FIG. 2. At first, when the usual (or normal)paper is used as the paper 10 and it is discharged in the face-up condition, the first paper-discharging tray 30 is used, so that the main tray portion 23 is manually rotated in the direction shown by the arrow A to be held at a position shown by a full line in FIG. 2. In this case, the first motor is driven and the cassette 8 other than that for use with envelopes is housed in the charging portion 9, so that the auxiliary tray portion 26 is rotated into the position in which its upper surface is aligned with the upper surface of the main tray portion 23 to provide the first paper-discharging discharging tray 30 with a straight upper surface (i.e. in the first posture). In this case, the paper 10 is not curled after fixing, so that the papers 10, which have been discharged in turn, are stably held on the first paper-discharging tray 30.

In addition, the first paper discharging tray 30 is also used when an envelope is used as the paper 10 and it is discharged in the face-up condition. But, in this case, the cassette 8 for use with envelopes is housed in the charging portion 9, so that the upper surface of the auxiliary tray portion 26 is bent upward from alignment with the upper surface of the main tray portion 23 (that is, the auxiliary tray portion 26 takes the second posture, as shown by an imaginary line in FIG. 2). And, in this case, even though the paper 10 is curled after fixing, the papers 10, which have been discharged in turn, are stably held on the first paper-discharging tray 30 which is bent to correspond with the curl of the paper 10.

Figure 2:
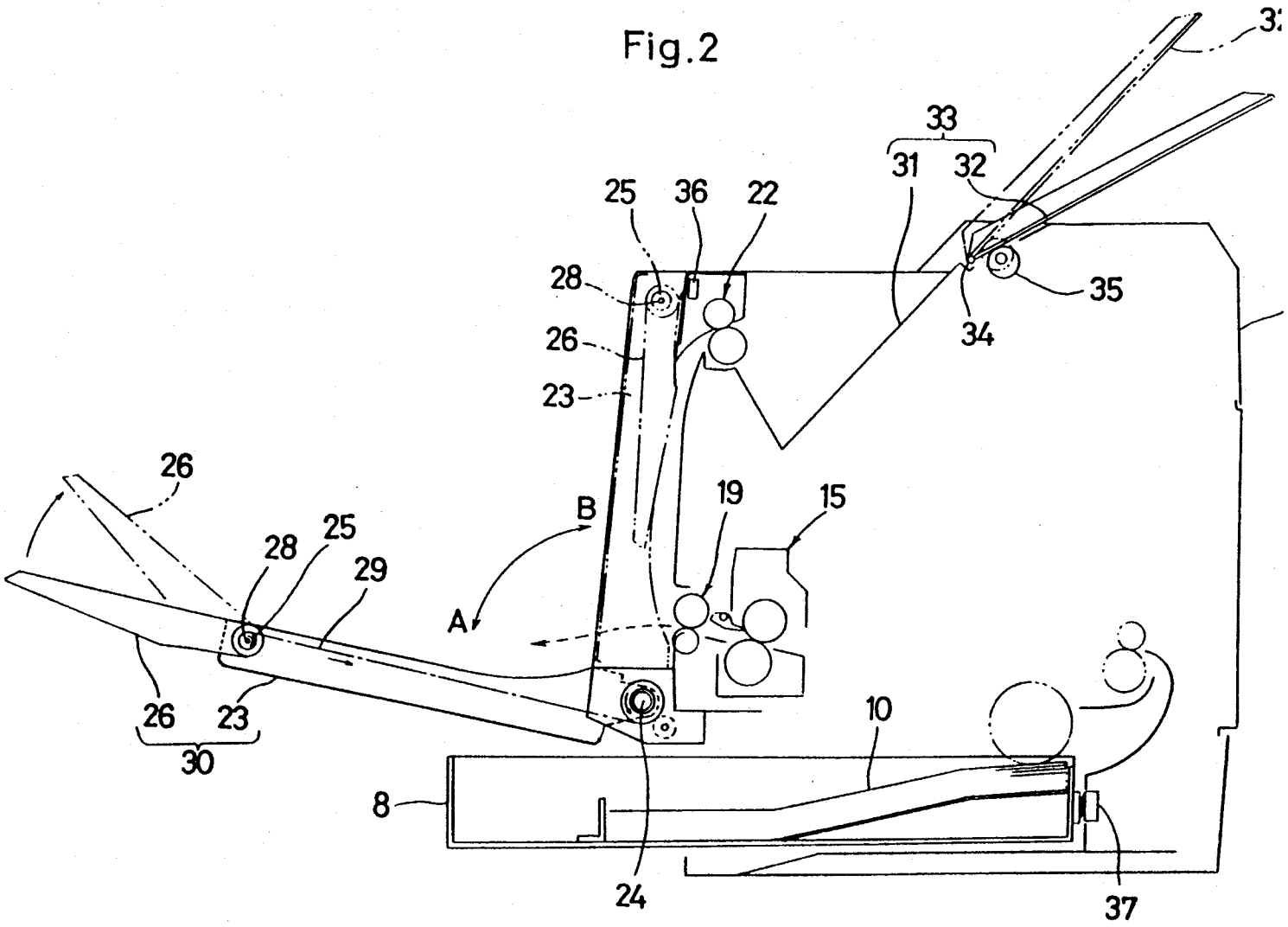
FIG. 2 is an operational diagram for the apparatus of FIG. 1.

On the other hand, when normal paper is used as the paper 10 and it is discharged in the face-down condition, the second paper-discharging tray 33 is used and the main tray portion 23 is positioned shown by an imaginary line in FIG. 2. In this case, the second motor is driven and the cassette 8 other than that for use with envelopes is housed in the charging portion 9, so that the auxiliary tray portion 32 is rotated into position in which the upper surface of the auxiliary tray portion 32 is aligned with the upper surface of the tray 31 to provide the first paper-discharging tray 33 with a straight upper surface (that is, the first paper-discharging tray is positioned in the first posture, as shown by an imaginary line in FIG. 2). And, in this case, the paper 10 is not curled after fixing, so that the papers 10, which have been discharged in turn, are stably held on the second paper-discharging tray 33.

In addition, when an envelope is used as the paper 10 and it is discharged in the face-down condition, the cassette 8 for use with an envelope is housed in the charging portion 9, so that the upper surface of the auxiliary tray portion 32 is bent downward from alignment with the upper surface of the tray 3 (that is, the auxiliary tray portion 32 takes the second posture, as shown by a full line in FIG. 2). And, in this case, even though the paper 10 is curled after fixing, the papers 10, which have been discharged in turn, are stably held on the second paper-discharging tray 33 bent to correspond to the curl of the paper 10.

In addition, when an unusually flexible paper is used as the paper 10 and it is discharged under the face-down condition, even the unusually flexible paper 10 can be discharged to rise along the sharply inclined tray 31. Thus the paper-discharging operation can be stably and surely conducted by bending the upper surface of the auxiliary tray portion 32 toward horizontal position from the upper surface of the tray 31 (that is, by positioning the auxiliary tray portion 32 closer to (a third posture)), in the same manner as in the above described case where the envelope is discharged in the face-down condition, so that the paper 10 can be stably held on an upper surface of the paper-discharging tray 33.

Although the paper-discharging trays 30 and 33 are adapted to be automatically adjusted at their free ends, respectively, depending upon the kind of paper-supplying cassette 8 (the paper 10) housed in the charging portion 9 in the above described preferred embodiment, the present invention is not limited by this embodiment. The free end of the paper-discharging tray 30 or 33 may be manually adjusted.

Figure 3:
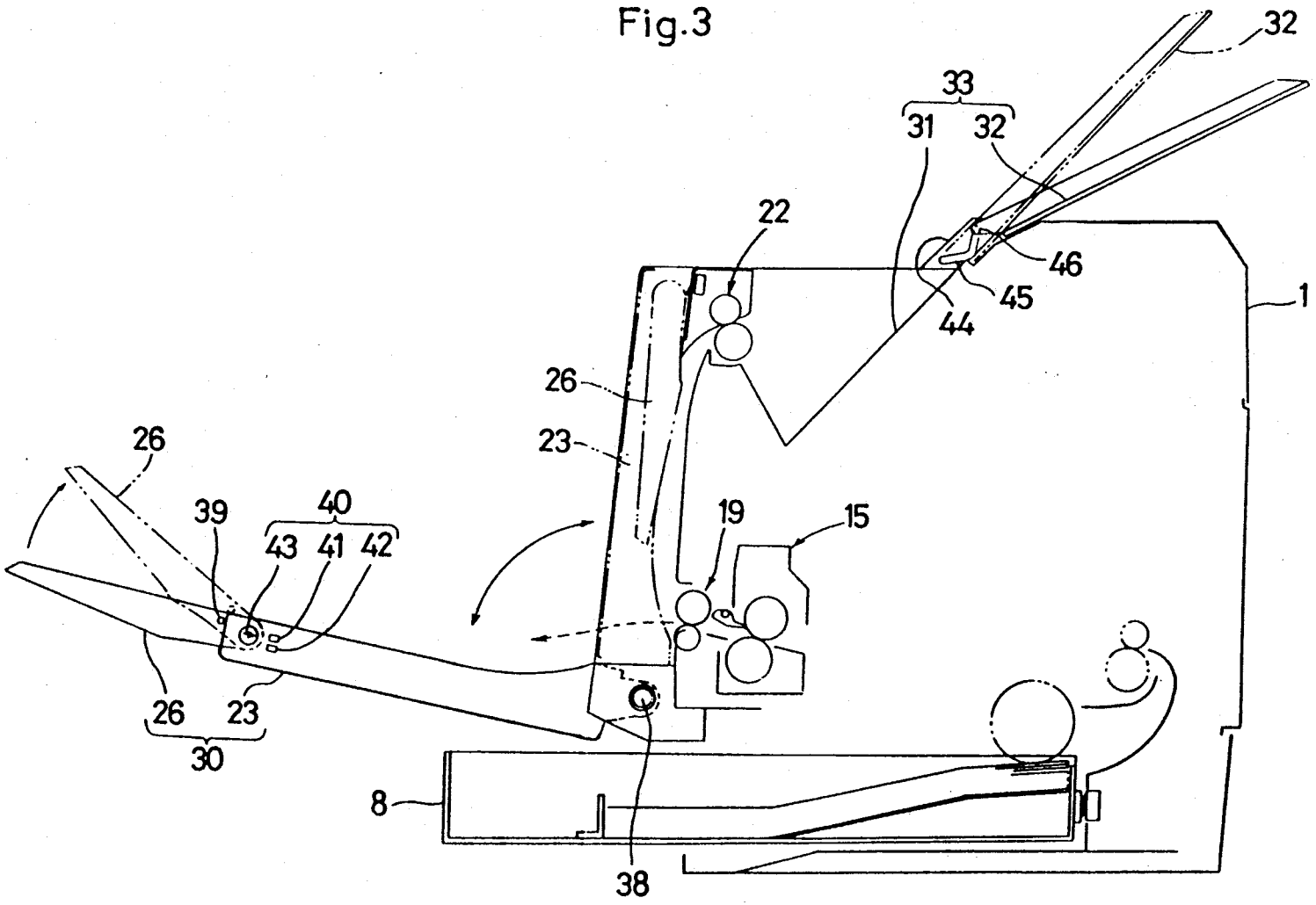
FIG. 3 is a rough longitudinal section side view showing only principal parts of a laser printer according to another preferred embodiment of the present invention.

FIG. 3 shows a preferred embodiment having such construction. A first paper-discharging tray 30 is constructed in the following manner. That is, the main tray portion 23 is held so as to be manually rotatable in a direction A–B with a horizontal shaft 38 as a center. In addition, the auxiliary tray portion 26 is rotatably mounted on a horizontal shaft (not shown) at a free end of the main tray portion 23. The auxiliary tray portion 26 is provided with a stopper projection 39 projecting from a side surface thereof. The stopper 39 can be engaged with an end of the main tray portion 23 in order to maintain an upper surface thereof aligned with an upper surface of the main tray portion 23 (the first posture), as shown by a full line in FIG. 3. The auxiliary tray portion 26 is held in a condition in which the upper surface of the auxiliary tray portion 26 is bent upwardly from alignment with the upper surface of the main tray portion 23 (a second posture by engagement of the stopper projection 39 with an upper portion of a side surface of the main tray portion 23, as shown by an imaginary line in FIG. 3.

In addition, the auxiliary tray portion 26 is provided with an indicator 40 near the position at which the main tray portion 23 is mounted to the auxiliary tray portion 26. That is, indicating marks 41, 42 indicating for example "usual paper" and "envelope", respectively, are provided on the side of the main tray portion 23 and the auxiliary tray portion 26 is provided with an arrow mark 43, so that the upper surface of the auxiliary tray portion 26 will be aligned with the upper surface of the main tray portion 23 (the first posture) when the arrow mark 43 is aligned with the indicating mark 42 indicating "usual paper", and the upper surface of the auxiliary tray portion 26 will be bent upward from the upper surface of the main tray portion 23 (the second posture) when the arrow mark 43 is aligned with the indicating mark 42 indicating "envelope".

A second paper-discharging tray 33 is constructed in the following manner. A support member 44 provided adjacent an upwardly projecting portion of the body 1 of the printer is provided with a hook-shaped guide hole 45 opening therethrough, and the auxiliary tray portion 32 is provided with a pin 46 on an end portion thereof so that the pin 46 may be engaged in and moved along the guide hole 45 upon movement of the auxiliary tray portion 32 between a position in which an upper surface of the tray 33 is aligned with an upper surface of the auxiliary tray portion 32 (a first posture) and a position in which the upper surface of the auxiliary tray portion 32 is bent downward from alignment with the upper surface of the tray 31 (a second posture).

In addition, the second paper-discharging tray 33 may be provided with an indicator in the same manner as the above described first paper-discharging tray 30.

And, it goes without saying that, with the above construction, the paper 10 can be reliably stacked after the fixing process by manually adjusting the position of the free end of the paper-discharging tray 30 or 33 depending upon the kind of paper-supplying cassette 8 (i.e. and thus the kind of paper 10) housed in the charging portion 9.

When the indicator is provided as in this preferred embodiment, the free end of the paper-discharging tray 30 or 33 can be easily adjusted.

Figure 4A:
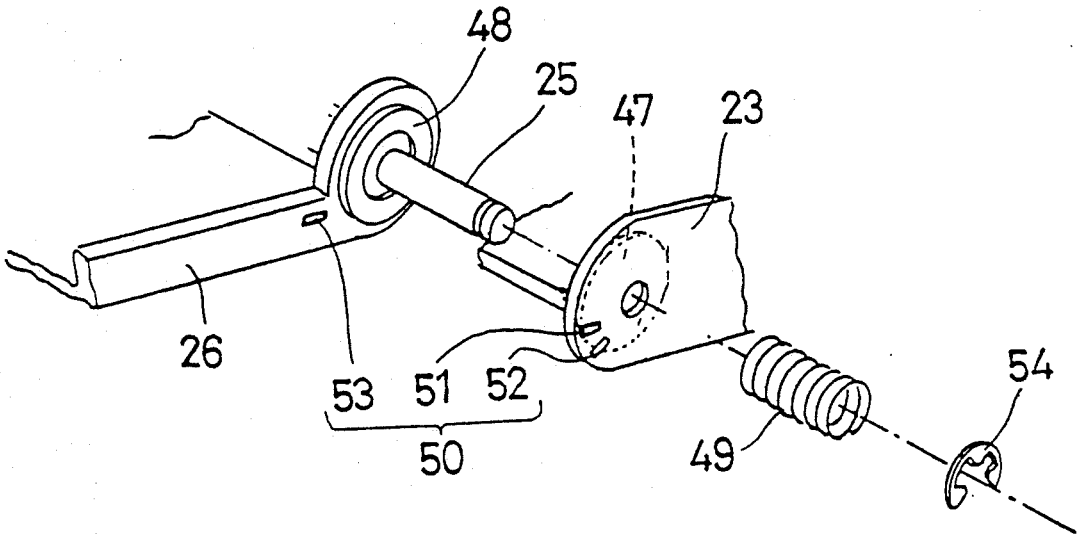
FIG. 4(A) is an exploded diagram showing constituent members of a tray according to the invention.
Figure 4B:
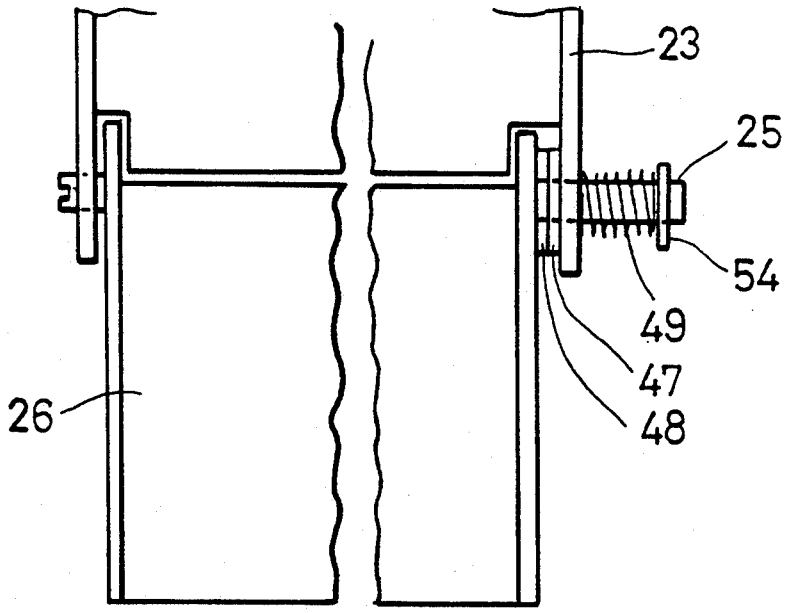
FIG. 4(B) is a plan view of the tray of FIG. 4(A) in assembled condition.
Figure 5:
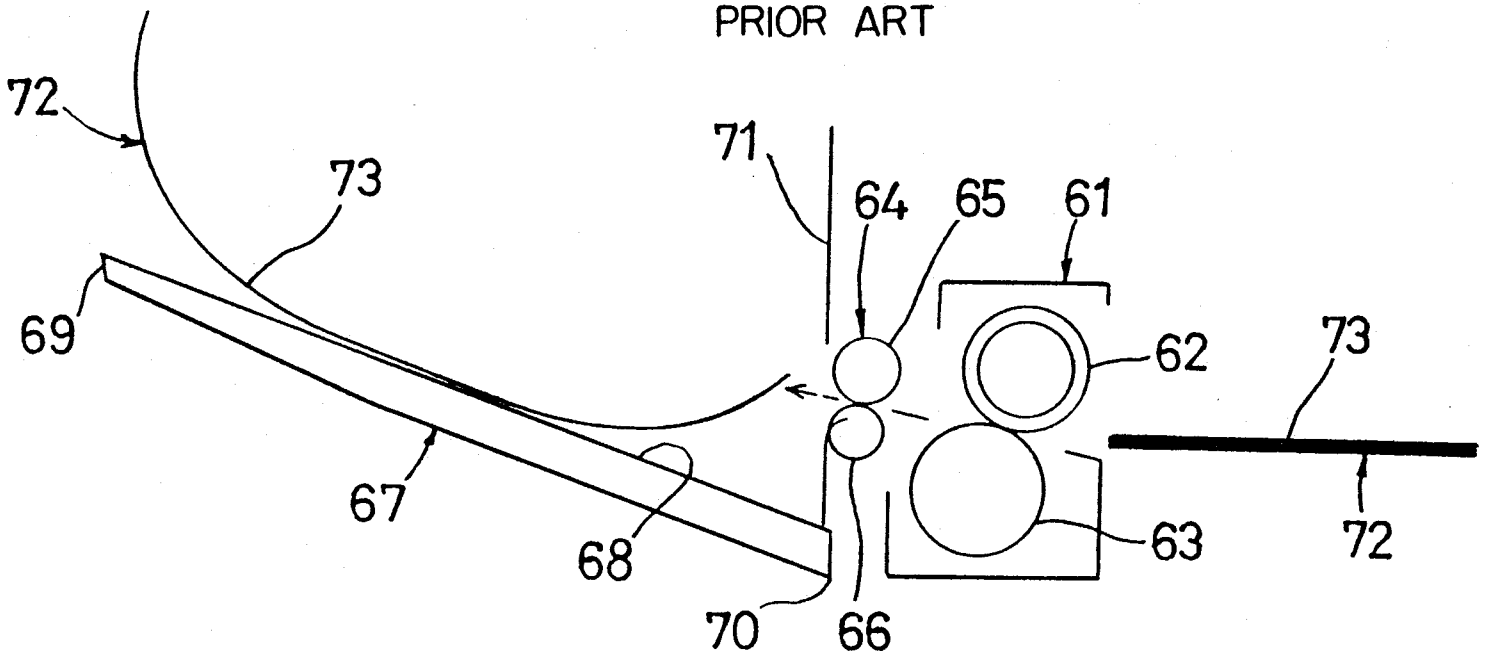
Fig.5 PRIOR ART
FIG. 5 is a diagram showing a prior art laser printer arrangement.

Furthermore, the auxiliary tray portion 26 may be mounted on the main tray portion 23 in the manner shown in FIGS. 4(A) and (B). That is to say, friction members 47, 48 are mounted on a surface of the main tray portion 23 and an opposing surface the auxiliary tray portion 26, respectively. The auxiliary tray portion 26 is always biased toward the main tray portion 23 by a coil spring 49, such that the auxiliary tray portion 26 can rotatably pivot relative to the main tray portion 23 with a frictional resistance present between the main tray portion 23 and the auxiliary tray portion 26. An indicator 5 can also be provided for this construction in a manner similar to the indicator 40. That is, indicating marks 50, 52 indicating, for example, "usual paper" and "envelope", respectively, are provided on the side of the main tray portion 23, and the auxiliary tray portion 26 is provided with an arrow mark 53. Reference numeral 54 designates an E-ring. In addition, the auxiliary tray portion 26 may be adapted to pivot in a stepless manner relative to the main tray portion 23, and a display may be correspondingly formed.

Although the main tray portion of the first paper-discharging tray 30 is also used as the passage-constituting member 23 in the above described respective preferred embodiments, such construction is not always necessary. In addition, the laser printer may be provided with any one of the first paper-discharging tray 30 and the second paper-discharging tray 33. Furthermore, it goes without saying that the paper-discharging trays of the present invention can be applied to an electrostatic photographic copying machine, a facsimile machine or the like.

The present invention has the above described construction. With the paper-discharging tray according to the present invention, not only normal paper such as copying paper, but also paper such as an envelope, liable to be curled during the fixing step and unusually flexible paper can be held without tumbling or falling from the tray.

Besides, with the paper-discharging tray according to the present invention, even particularly flexible paper can be discharged to properly rise along the sharply inclined surface. Thus, the paper-discharging operation can be stable and reliably conducted, so that the paper can be stably stacked along the upper surface of the paper-discharging tray in the face-down condition.

What is claimed is:

1. A paper-discharge tray for holding paper discharged by a paper-discharging device after the paper has undergone a fixing treatment in an image forming machine, said paper-discharge tray comprising:

a main tray portion adapted to be disposed on the image-forming machine and to hold a main portion of the paper;

an auxiliary tray portion pivotably mounted to said main tray portion for movement between a first position in which an upper surface of said auxiliary tray portion is aligned with an upper surface of said main tray portion, and a second portion in which said upper surface of said auxiliary tray portion is inclined from alignment with said upper surface of said main tray portion in order to cause said paper-discharge tray to correspond in shape with a shape of the paper after it has been curled during the fixing treatment; and means for maintaining said auxiliary tray portion in each of said first and second positions.

2. A paper-discharge tray as recited in claim 1, further comprising a pivot shaft pivotably mounting said auxiliary tray portion to said main tray portion; and wherein said means for maintaining comprises a pulley mounted on said pivot shaft, and a wire trained about said pulley.

3. A paper-discharge tray as recited in claim 1, wherein said means for maintaining comprises a stopper projection on a side surface of said auxiliary tray portion, said stopper projection respectively engaging with different portions of said main tray portion to maintain said auxiliary tray portion in said first and second positions.

4. A paper-discharge tray as recited in claim 1, wherein said means for maintaining comprises friction means for creating sufficient frictional contact between said main tray portion and said auxiliary tray portion to selectively maintain said auxiliary tray portion in any pivotal position relative to said main tray portion.

5. A paper-discharge tray as recited in claim 4, wherein said friction means comprises a first friction member mounted on said main tray portion, a second friction member mounted on said auxiliary tray portion, and spring means for biasing said first and second friction members toward one another.

6. A paper-discharge tray as recited in claim 1, wherein said means for maintaining comprises a support member mounted to said main tray portion and having a hook-shaped guide slot formed therein, and a pin mounted to said auxiliary tray portion and engaged in said guide slot.

7. A paper-discharge tray as recited in claim 1, wherein said means for maintaining comprises a cam member rotatably mounted to said main tray portion and engaged with said auxiliary tray portion.

8. A paper-discharge tray as recited in claim 1, further comprising motor means for pivoting said auxiliary tray portion relative to said main tray portion between said first and second positions.

9. A paper-discharging tray as recited in claim 1, further comprising indicator means for indicating the position in which the auxiliary tray portion is set to thereby indicate a type of paper which said paper-discharge tray is adapted to hold.

10. A paper-discharge tray as recited in claim 9, wherein said indicator means comprises a pair of indicating marks on said main tray portion and an indicating arrow on said auxiliary tray portion adapted to point toward said indicating marks when said auxiliary tray portion is in said first and second positions, respectively.

11. A paper-discharge tray as recited in claim 1, wherein in said second position, said upper surface of said auxiliary tray portion is inclined upwardly from alignment with said upper surface of said main tray portion.

12. A paper-discharge tray as recited in claim 1, wherein in said second position, said upper surface of said auxiliary tray portion is inclined downwardly from alignment with said upper surface of said main tray portion.

13. A paper-discharge tray for holding a paper discharged by a paper-discharging device after undergoing a fixing treatment by a fixing device of an image-forming machine, said paper-discharge tray comprising:

a main tray portion constituting a base end of said paper-discharge tray;

an auxiliary tray portion constituting a free end of said paper-discharge tray and being arranged bendably relative to said main tray portion such that said paper-discharge tray can be bent into at least two postures including a posture in which said auxiliary tray portion is bent in a direction in which the paper may become curled during the fixing treatment;

wherein said auxiliary tray portion is supported by said main tray portion and is adapted to be stopped in said at least two postures; and a friction means is provided for creating frictional resistance between said main tray portion and said auxiliary tray portion in order to support said auxiliary tray portion in various postures in a stepless manner.

14. A paper-discharge tray as recited in claim 13, wherein said auxiliary tray portion is pivotably connected to said main tray portion; and said friction means comprises a first friction member mounted on said auxiliary tray portion, a second friction member mounted on said main tray portion, and a spring means for biasing said first friction member against said second friction member.

15. A paper-discharge tray for holding a paper discharged by a paper-discharging device after undergoing a fixing treatment by a fixing device of an image-forming machine, said paper-discharge tray comprising:

a main tray portion constituting a base end of said paper-discharge tray;

an auxiliary tray portion constituting a free end of said paper-discharge tray and being arranged bendably relative to said main tray portion such that said paper-discharge tray can be bent into at least two postures including a posture in which said auxiliary tray portion is bent in a direction in which the paper may become curled during the fixing treatment;

wherein said auxiliary tray portion is pivotably connected to said main tray portion and is adapted to be pivoted manually relative to said main tray portion; and wherein said auxiliary tray portion is provided with an indicator at the pivot connection between said auxiliary tray portion and said main tray portion for indicating the posture in which said paper-discharge tray is arranged and thus the type of paper which said paper-discharge tray is adapted to hold.

16. A paper-discharge tray for holding a paper discharged by a paper-discharging device after undergoing a fixing treatment by a fixing device of an image-forming machine, said paper-discharge tray comprising:

a main tray portion constituting a base end of said paper-discharge tray;

an auxiliary tray portion constituting a free end of said paper-discharge tray and being arranged bendably relative to said main tray portion such that said paper-discharge tray can be bent into at least two postures including a posture in which said auxiliary tray portion is bent in a direction in which the paper may become curled during the fixing treatment; and motor means for bending said auxiliary tray portion relative to said main tray portion in order to adapt said paper-discharge tray to receive different types of paper.

17. A paper-discharge tray as recited in claim 16, further comprising:

a paper detecting means for detecting a type of paper being used by detecting a type of paper cassette being used with the image-forming machine.

18. A paper-discharge arrangement for an image-forming machine having a fixing device and a paper-discharging device arranged downstream of the fixing device, said paper-discharge arrangement comprising:

a first paper-discharge tray pivotably mounted to the image-forming machine for movement between a first position in which it is adapted to receive paper in a face-up condition discharged by the paper-discharging device and a second position in which it functions as one side of a guide for guiding the paper to be discharged in a face-down condition, said first paper-discharge tray comprising a first main tray portion and a first auxiliary tray portion arranged bendably relative to said first main tray portion such that said first paper-discharge tray can be bent into at least two postures including a posture in which said first auxiliary tray portion is bent in a direction which the paper discharged by the discharging device may become curled when passing through the fixing device;

a second paper-discharge tray adapted to receive the paper discharged in the face-down condition and including a second main tray portion and a second auxiliary tray portion pivotably mounted to said second main tray portion;

first motor means for moving said first auxiliary tray portion relative to said first main tray portion;

second motor means for moving said second auxiliary tray portion relative to said second main tray portion; and switch means for operating said first and second motor means, said switch means being switched between on and off positions upon movement of said first main tray portion of said first paper-discharge tray.

19. A paper-discharge tray for holding, in a face-down condition, a paper discharged by a paper-discharging device after undergoing a fixing treatment by a fixing device of an image-forming machine, said paper-discharge tray comprising:

an upwardly inclined main tray portion adapted to hold a main portion of the paper;

an auxiliary tray portion pivotably mounted to said main tray portion for movement between at least three positions; and motor means for pivotably moving said auxiliary tray portion to adapt said paper-discharge tray for use with different kinds of paper.

20. A paper-discharge tray as recited in claim 19, further comprising detecting means for detecting a type of paper being used by detecting a type of paper cassette being used with the image-forming machine.

* * * * *